US005112184A

United States Patent [19]

Tapper et al.

[11] Patent Number: 5,112,184

[45] Date of Patent: May 12, 1992

[54] MULTI-FUNCTION HYDRAULIC CONTROL HANDLE

[75] Inventors: Glen D. Tapper; Timothy J. Raymond; Ernest E. Enlund, all of Duluth, Minn.

[73] Assignee: Reach All, Duluth, Minn.

[21] Appl. No.: 535,836

[22] Filed: Jun. 11, 1990

[51] Int. Cl.[5] ..... B66C 23/60

[52] U.S. Cl. ..... 414/728; 74/471 XY; 414/4; 414/729; 137/636.2; 137/636.3; 137/636.4

[58] Field of Search ..... 414/729, 4, 5, 6, 718, 414/728, 687, 2; 74/471 XY; 137/636.2, 636.3, 636.4

[56] References Cited

U.S. PATENT DOCUMENTS

| | | | |
|---|---|---|---|
| 2,401,258 | 5/1946 | Livers . | |
| 2,549,969 | 4/1951 | Hesemann . | |
| 2,679,327 | 5/1952 | Hren . | |
| 2,877,660 | 3/1959 | Rush . | |
| 2,951,393 | 9/1950 | Schroeder et al. . | |
| 3,088,328 | 5/1963 | Peterson . | |
| 3,131,574 | 5/1964 | Clingerman . | |
| 3,338,269 | 8/1967 | Carbert et al. . | |
| 3,589,240 | 5/1971 | Levesque . | |
| 3,618,786 | 11/1971 | Fick | 414/5 |
| 3,637,092 | 1/1972 | George et al. | 414/5 |
| 3,698,580 | 10/1972 | Carlson et al. | 414/4 X |
| 3,707,093 | 12/1972 | Worden | 74/471 XY |
| 3,726,312 | 4/1973 | Wagnum . | |
| 3,768,328 | 10/1973 | Campbell . | |
| 3,854,380 | 12/1974 | Casey . | |
| 3,918,496 | 11/1975 | Byers, Jr. . | |
| 4,067,546 | 1/1978 | Matsuda et al. . | |
| 4,140,027 | 2/1979 | Wineburner et al. . | |
| 4,158,968 | 6/1979 | Wilson et al. . | |
| 4,185,662 | 1/1980 | Wada et al. . | |
| 4,187,737 | 2/1980 | Mori et al. . | |
| 4,213,484 | 7/1980 | Habiger . | |
| 4,397,336 | 8/1983 | Godfrey . | |
| 4,404,991 | 9/1983 | Cullen . | |
| 4,553,446 | 11/1985 | Matsubara . | |
| 4,646,778 | 3/1987 | Tsuji et al. . | |
| 4,724,924 | 2/1988 | Breyer et al. . | |
| 4,736,647 | 4/1988 | Shimoie et al. . | |
| 4,950,116 | 8/1990 | Nishida | 414/5 |

OTHER PUBLICATIONS

Pitman Polecut P Series brochure for Models P42, P45, P50, P60 & P70, manufactured by Reach All, Inc.

Pitman Polecut M Series brochure for Models M42, M45, M47 & M50, manufactured by Reach All, Inc.

Gresen Model U12 Sectional Body Directional Contact Valves brochure, a Dana Corporation Company.

*Primary Examiner*—Robert J. Spar
*Assistant Examiner*—Donald W. Underwood
*Attorney, Agent, or Firm*—Merchant, Gould, Smith, Edell, Welter & Schmidt

[57] ABSTRACT

A control system is provided. The control system allows for control of four independent movement functions with an overriding safety switch or deadman switch. The four different movement functions can be operated simultaneously, or independently, as desired. In preferred embodiments the movement functions of the control handle are coordinated to movement of the controlled device.

10 Claims, 10 Drawing Sheets

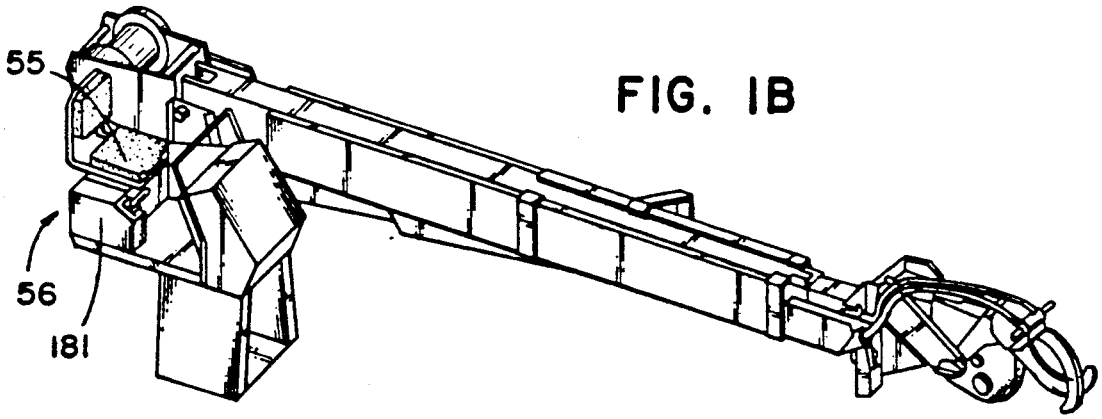
FIG. 1B
FIG. 1D
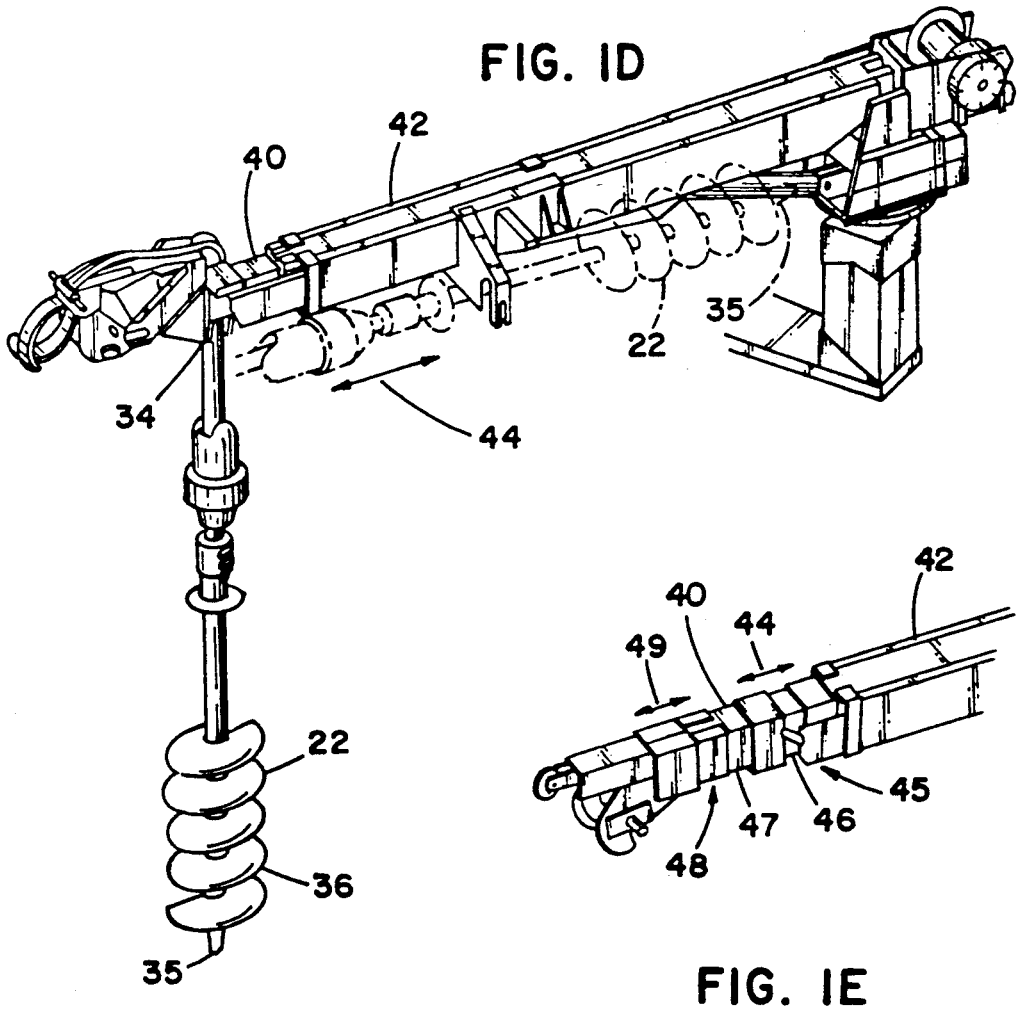
FIG. 1E

FIG. IC

| HANDLE MOVEMENT | BOOM MOVEMENT |
|---|---|
| 1a) UPWARD<br>1b) DOWNWARD | 1a) UPWARD<br>1b) DOWNWARD |
| 2a) ROTATE TO RIGHT<br>2b) ROTATE TO LEFT | 2a) ROTATE TO RIGHT<br>2b) ROTATE TO LEFT |
| 3a) IN<br>3b) OUT | 3a) CONTRACTION<br>3b) EXTENSION |
| 4a) TWIST TO RIGHT<br>4b) TWIST TO LEFT | 4a) EXTENSION<br>4b) CONTRACTION |

80
105
188

85
107
105
162
160
103
90
166
100
106
120
75
154
152
150
153
145
174
140
147
149
122
121
123
195
99
108
117
118
110
196
112
113
114
115
116
172
173
170
171
164
175
182
166
180

160
131
1020
1010
130
132
1030
133
1040
190
189
191
180
160

FIG. 8B
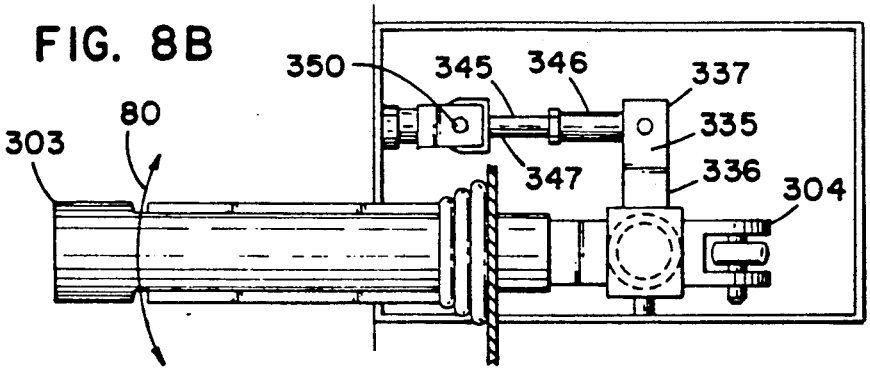
FIG. 8C
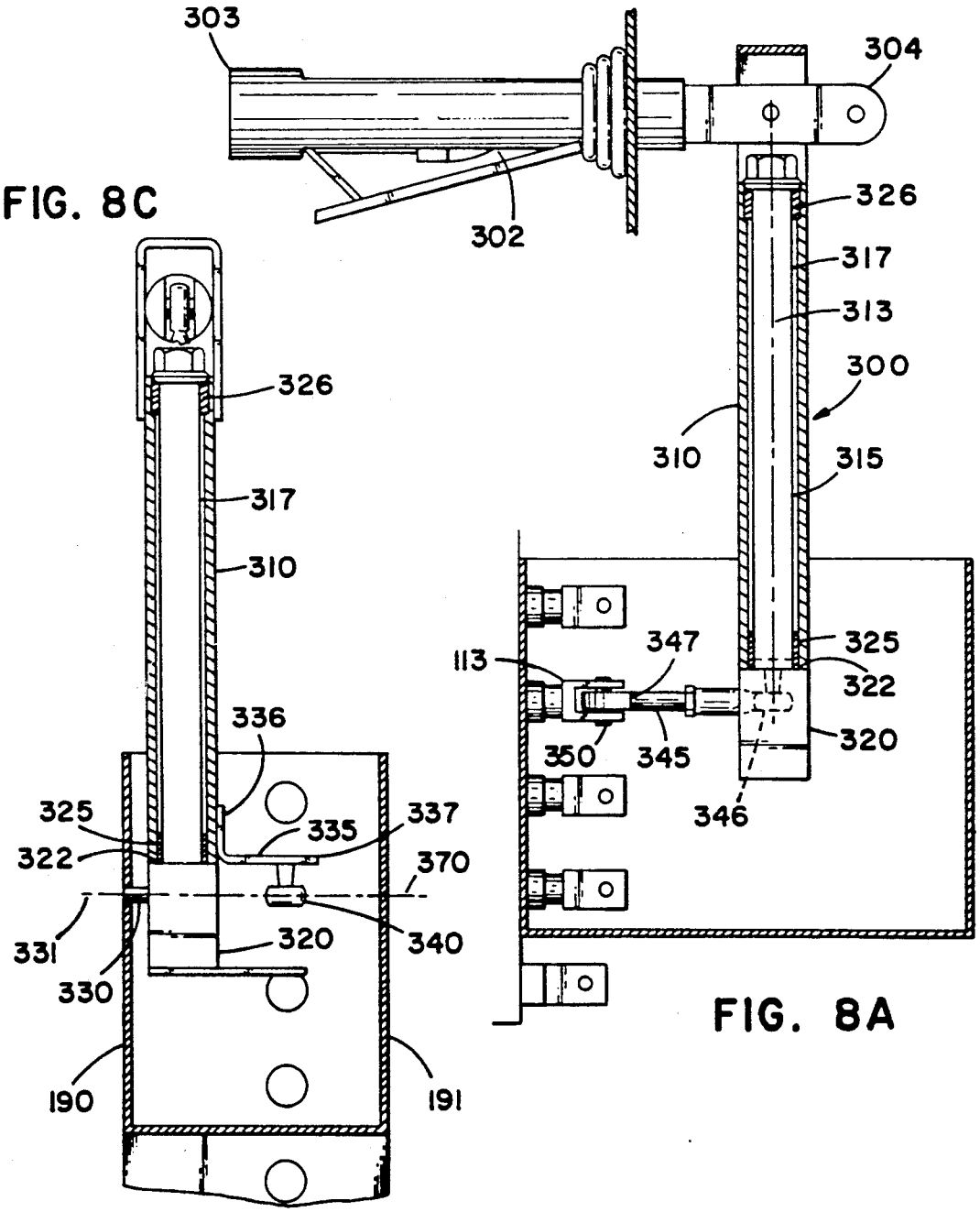
FIG. 8A

MULTI-FUNCTION HYDRAULIC CONTROL HANDLE

FIELD OF THE INVENTION

The present invention relates to control systems for operating one or more devices or equipment. Such a control system is typically used in the operation of crane-like equipment that is moveable in one or more directions to position it as desired. In particular, the invention relates to a mounted control handle constructed and arranged to be movable through a number of paths of motion to selectively and independently operate or move the equipment as desired. More specifically, the present invention relates to such control systems that include a safety actuator or switch for preventing undesired movement of the equipment.

BACKGROUND OF THE INVENTION

Generally, there are a number of types of apparatus which function to move an object in various directions. Among these apparatus are included power-operated shovels, cranes, personnel supporting booms, digger derricks and many others. These arrangements generally include a boom mounted at a first end to a platform, particularly a platform on a vehicle. The boom is attached to the platform such that it may be moved in a variety of directions. A second opposite end of the boom is typically adapted to mount one or more tools thereon. For instance, a shovel might be attached to the opposite end of the boom for digging. Alternatively, a bucket for carrying or supporting an individual might be attached to the end of the boom. Tools, such as tong-like pinchers or claws for grasping and steadying an article might be disposed at the end of the boom. Further, an auger or drill-like tool may be attached to the boom for drilling holes in the ground. The boom may be equipped with a winch and cable arrangement for lifting an article.

The boom is typically attached to the platform in such a way that the boom can move in several directions to position the tools as desired. For instance, the boom may be pivotally attached at its first end such that it can rotate in an arc or semicircle lying in a plane that is generally vertical, or in other words generally perpendicular to the surface on which the vehicle rests. Additionally, the boom may be pivotally attached at its first end to rotate about a generally vertical axis; that is, through an arc lying in a plane generally parallel to the surface on which the vehicle rests, typically horizontal.

It should be noted that throughout this application, the plane describing the surface on which the vehicle rests will be described as horizontal or generally horizontal for convenience reference to the drawings. Similarly, the plane perpendicular to the plane on which the vehicle rests will be described throughout as vertical. It is to be understood that the vehicle can be used on hills and the like and therefore the plane on which the vehicle rests will not necessarily be horizontal.

In addition to being movable in horizontal and vertical arcs, the boom may also be constructed and arranged to be extendable. That is, it may include telescopic portions which can be extended to increase the overall length of the boom.

By these and other movements, it will be possible to position the boom in such a manner that the tools (shovel, bucket, platform, claw, auger, winch line, etc.)

will be at the desired position and can perform the desired tasks.

A digger derrick is such an apparatus. It is typically used to perform three primary functions: (1) to dig holes for poles for supporting power lines; (2) to provide tong-like grips and a winch arrangement for lifting and carrying a pole for supporting power lines, particularly to transport and position a pole into or out of one such hole; and (3) to support a worker or workers on a platform or in a bucket at the second end of the boom to lift the worker to perform necessary tasks on power lines.

Controls are required for causing the boom to perform the desired motions or functions. Typically, such apparatus can include a turret-like seat at the first end of the boom in which an operator is seated. A control panel is provided within reach of the operator. Typically, a control panel will be disposed in front of the operator, and a lever will be provided extending upward from the floor between the operator's legs. Alternatively, the operator's station and the controls may be remote from the rotational assembly of the boom, so that the operator does not move with the boom.

Typically, the controls are connected via a series of linkages to hydraulic valves which in turn are operationally connected to mechanisms for moving the boom in a particular fashion.

Safety is an important consideration in the design of such control arrangement. It is desirable that at least certain of the controls are operated in conjunction with a spring-loaded safety actuator or dead-man switch, that is, a switch which, unless activated, precludes the activation of the control. For instance, if the control for causing the boom to move in an up/down fashion (i.e. in a vertical arc) were connected to a control handle in conjunction with a dead-man switch, it would not be possible to activate the boom up/down control without simultaneously activating the dead-man switch.

Frequently, it is desired to move the boom through a rather complex motion or operation, requiring simultaneous activation of more than one of the movement controls. For instance, it may be desired to move the boom upward while at the same time moving it in an arc to the left of its original position. To do so would require activation of both the boom up/down movement control as well as the rotation control. Additionally, it may be desired to increase or decrease the length of the boom while traversing the desired path. Alternatively, it may be desired to move the boom through a series of motions in relatively rapid succession, rather than simultaneously. In short, it can be seen that it is desirable that the movement controls be arranged at the operator'disposal in a manner which conventionally allows the operator to activate more than one of the movement controls at the same time or sequentially. It is further desirable that the controls be operable in an intuitively sensible manner so that training time is reduced and safety of operation is enhanced.

For safety reasons, it can be seen that it is desirable that each of the movement controls be connected through a dead-man switch. Thus, it can be seen that what has been needed is a control operable with one hand which activates more than one, and preferably all, of the movement controls that govern movement of the boom. It would be desirable for that control to be operable with a single hand of the operator, so that the operator's other hand is free to activate controls to use particular tools on the boom (for instance, tong-like pinchers which need to be opened and closed to squeeze an object therebetween). It is further desirable that the control include a dead-man switch which would prevent activation of any and all of the movement controls when the dead-man switch is not activated.

It is further desirable that the control system be relatively maintenance free. It is desirable that the parts used in the system be resistant to wear, be relatively unaffected by severe temperature changes, and require little or infrequent lubrication.

OBJECTS OF THE INVENTION

It is an object of this invention to provide a control system by which a plurality of movement functions of equipment, such as a boom on a digger derrick, can be controlled with one hand of the operator in conjunction with a safety actuator or dead-man switch. In particular, it is desirable that the control system be adapted to control four movement functions with a single handle control, with a dead-man switch provided and adapted to be activated on the handle to prevent each of the movement controls from being operable unless the dead-man switch is activated or engaged.

SUMMARY OF THE INVENTION

The present invention concerns a control system for allowing control of all movement functions of maneuverable equipment, such as a boom on a digger derrick, with a single handle control. The control system includes a safety actuator or dead-man switch located on the handle to prevent activation of any of the movement controls unless the dead-man switch is activated. Further, the safety actuator when activated does not interfere with the activation or deactivation of the movement controls.

Although the control system of the present invention is contemplated for use with any apparatus in which control of a plurality of functions with a single control would be advantageous, the control system of the present invention is described throughout in conjunction with use on a digger derrick apparatus to control movement functions of a boom.

One conventional digger derrick provides a boom that is constructed and arranged with four movement functions. That is, the boom is capable of moving in four ways or manners. These four manners of movement will be referred to as movement functions. Movement of the boom in one or more of these manners allows the operator to position the free end of the boom and the tools or equipment attached thereto as desired. Each of the four movement functions is created by movement of structural mechanisms that may, for instance, be hydraulic. These mechanical structures are activated when actuators, such as control valves, in the control system are positioned in a predetermined manner.

The four movement functions of the particular boom depicted are as follows:

(1) The boom up/down or "elevation" movement function—This function allows the boom to move in an arc in a vertical plane, pivoting at its end attached to the vehicle about a substantially horizontal axis;

(2) The side to side or "rotation" movement function—The rotation function allows the boom to move in an arc or circle in a generally horizontal plane, or in a plane not rotating with respect to a horizontal plane, rotating about a substantially vertical axis at the end of the boom attached to the vehicle;

(3) The "tele 1" movement function—The tele 1 function provides for the extension of a first portion of the boom;

(4) The "tele 2" movement function—The tele 2 function allows a second portion of the boom to extend.

It is to be understood that each of the movement functions is described independently above. In typical use, it is frequently desired to combine one or more of these movement functions at one time or in relatively rapid succession to efficiently and quickly maneuver the boom to the desired location. For instance, it may be desirable to move the boom upward and to one side. These movements may be accomplished simultaneously by simultaneously activating the boom up./down and the rotation movement functions. Alternatively, these movements may be accomplished by first activating the boom up/down movement function and thereafter activating the rotation movement function.

The present invention provides a control system for controlling each of the four movement functions by movement of a single handle. The control system has an input receiving end and an opposite output end. Input, such as a force, is received by the handle. Output is translated away from the system by output movement means.

The handle is mounted alongside the operator, with a free end of the handle extending generally in the direction the operator would typically face. The handle is constructed and arranged such that means are provided for allowing the handle to move along four defined paths of motion. These paths of motion will described in detail below in conjunction with the discussion of FIG. 2. Preferably, the handle is constructed and arranged to move in a fashion that mimics the movement of the boom or other equipment.

Linkage means are provided to translate motion from the handle to the equipment actuators, such as control valves. More specifically, each of the four handle movements is associated with movement of a control valve for one movement function. Linkages are provided for translating handle motion to valve motion. The linkage means include means to allow each of the movement functions to be operated independently or simultaneously. That is, each handle movement means is operable to effect movement of an associated valve without affecting the position of any other valve. Consequently, each handle movement means is operable without causing any movement of the boom other than the movement function associated with that particular handle movement means.

The handle additionally includes a trigger for operating a safety actuator or dead-man switch. The dead-man switch is operatively associated with each of the four valves controlling the movement functions. Thus, it is necessary to activate the dead-man control in order for any of the movement functions to be operable. In the preferred embodiment, the handle includes a squeeze trigger that must be squeezed at all times for any of the boom movement functions to operate. If the operator releases the squeeze trigger, none of the four boom movement functions will be operable.

A detailed description of specific features leading to the above general features and advantages will be understood from the detailed description and drawings discussed below. Generally, the drawings do constitute a part of the specification and include exemplary embodiments of the present invention, while illustrating various objects and features thereof. It will be understood then in some instances relative component sizes and thicknesses may be shown exaggerated to facilitate an understanding of the invention.

BRIEF DESCRIPTION OF THE DRAWINGS

In the drawings, in which like reference numerals indicate corresponding parts through several views.

FIG. 1*b* is a fragmentary, perspective view of a digger derrick like that shown FIG. 1*a* taken from a different angle.

FIG. 1*c* is a schematic, fragmentary, enlarged, overhead view of an operator's station in a preferred embodiment of a digger derrick like that shown in FIG. 1*a*, and incorporating a control system according to the present invention.

FIG. 1*d* is a fragmentary perspective view of a digger derrick like that illustrated in FIG. 1*a*, showing an auger tool in its in-use position, with its storage position indicated in phantom.

FIG. 1*e* is a fragmentary, enlarged, perspective view of a boom on a/digger derrick like that shown in FIG. 1*a*.

FIG. 8*a* is a cross-sectional, fragmentary, side view of a portion of a linkage in a control system for controlling one movement function of the control system as illustrated in FIG. 4, with portions broken away to show internal detail;

FIG. 8*b* is a cross-sectional, fragmentary, top view of the linkage illustrated in FIG. 8*a;*

FIG. 8*c* is a cross-sectional, fragmentary, right side view of the linkage illustrated in FIG. 8*a;*

DETAILED DESCRIPTION OF THE PREFERRED EMBODIMENTS

As required, detailed embodiments of the present invention are disclosed herein. However, it is to be understood that the disclosed embodiments are merely exemplary of the invention, which may be embodied in various forms. Therefore, specific structural and functional details disclosed herein are not to be interpreted as limiting, but rather as a basis for the claims and as a representative basis for teaching one skilled in the art to variously employ the present invention and virtually appropriately detailed structure.

Figure 1A:
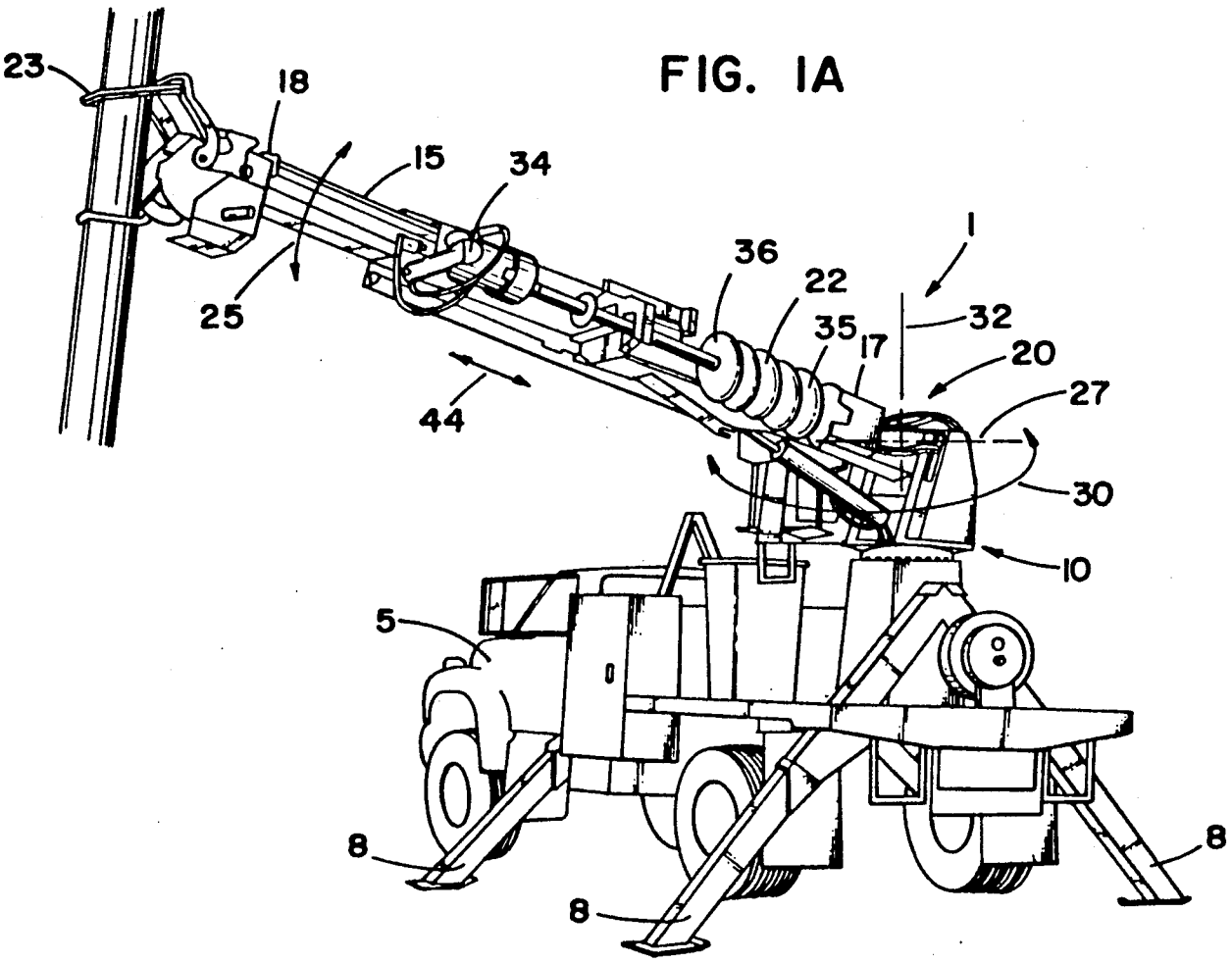
FIG. 1*a* is a perspective view of a digger derrick on which a control system according to the present invention may be used.

Referring to FIG. 1*a*, a digger derrick is illustrated. As noted above, the control system of the present arrangement is adaptable for use with any equipment requiring maneuverability of all or portions of the equipment, such as crane-like apparatus. It is particularly useful, however, in a digger derrick, and therefore is described with respect to the use of a boom on a digger derrick.

A digger derrick is represented generally by the reference numeral 1 in FIG. 1*a*. The digger derrick shown is mounted on a truck or other vehicle 5. A truck 5 or other vehicle allows the digger derrick to be conveniently transported from location to location. The truck may be typically equipped with support legs 8 which may engage the ground and support the digger derrick.

The digger derrick includes a base portion or rotating assembly 10 and a boom or boom portion 15. Boom portion 15 includes first and second ends 17 and 18, respectively. The boom is attached at its first end 17 to the rotating assembly 10.

The digger derrick is particularly well suited to perform three primary tasks in the installation and maintenance of power lines and the poles supporting power lines. These functions are as follows:

(1) To dig holes for power poles. The digger derrick is equipped with an auger-like tool 22. The auger tool 22 is an elongate member being pivotally attached at a first end 34 to the second end 18 of the boom 15. At the second opposite end 35 of the auger like tool 22, is a drill-like bit 36. Auger end 34 is pivotally attached to the boom 15, such that the auger tool can be pivoted between a position in which the auger tool 22 is parallel to and preferably removeably attached at its second end 34 to, the boom 15 for storage, and a second position in which the auger tool 22 is generally perpendicular to the boom 15 or perpendicular to the surface into which it is drilling for use. This is illustrated in FIGURE 1*d*.

(2) To carry into position and hold power poles. The digger derrick may be equipped with a winch arrangement for lifting poles. Additionally, a poleclaw 23 may be used in conjunction with the winch arrangement to steady or stabilize a pole being lifted by the winch arrangement as illustrated in FIG. 1*a*. The pole claw 23 is a tong-like arrangement including, for example, two tongs that can pinch or grasp a pole therebetween.

(3) To lift personnel. The second end of the boom 15 may also be adapted to include a bucket or a platform to lift a worker for performing various tasks which are out of reach.

To perform these and other tasks, it is desirable for the boom 15 to be moveable or maneuverable in a variety of directions.

An attachment or connecting arrangement 20 between the boom portion 15 and the base portion 10 allows for movement of the boom 15 in an up/down fashion as illustrated by the arc at reference numeral 25, FIG. 1*a*. In this manner, the boom portion 15 rotates about a horizontal axis 27.

Further, the connecting arrangement 20 is mounted to the truck 5 in such a manner that the rotating assembly can rotate about a vertical axis 32. The boom 15 is mounted to the rotating assembly 10 in such a manner that it rotates with the rotating assembly 10 about the vertical axis 32.

Means are provided for moving the boom 15 through the up/down arc 25. Additionally, means are provided for moving boom 15 in the rotation arc 30.

Additionally, the boom 15 is extendable , FIG. 1*d*. It includes an inner boom 40 and an outer boom 42 telescopically engaged, with the inner boom 40 being slidable to extend the length of the boom 15. In the embodiment shown, the inner boom 40 is proximate the second end 18 of the boom 15. Means are provided which allow the inner boom 40 to be extended outward from the outer boom 42 in the direction indicated by arrow 44. The extension means is generally indicated at reference numeral 45, FIG. 1*e* and is referred to hereafter as the "tele 1" movement function means.

A fourth boom movement is provided as shown in FIG. 1*e*, the inner boom 40 includes a first and second stages 46 and 47. The first stage 46 is proximate the outer boom 42 and the second stage 47 extends from the first stage in a direction toward the second end 18 of the boom 15 as indicated by arrow 49 in FIG. 1*c*. Means 48 are provided for extending the second stage 47 outwardly from the first stage 46. This movement function will hereinafter be identified as "tele 2" movement function.

Thus, the boom portion 15 is adapted for four movement functions: (1) boom up/down; (2) rotation; (3) tele 1; and (4) tele 2.

Typically in use, the digger derrick 1 is operated by a single operator seated in a control seat or operator's seat 55 in an operator's station 56, FIG. 1*b*. The operator's seat 55 is preferably attached to the digger derrick at the rotational assembly 20 such that the operator's seat preferably moves rotationally with the boom portion 15. That is, the operator's seat is preferably turret-like, and follows the rotation of the boom 15 in the horizontal plane. The operator's seat preferably does not, however, move with the boom 15 through its up/down motion or its extension motions (tele 1 and tele 2). The arrangement of the operator's seat, the operator's controls, and the boom 15 is illustrated in FIG. 1*c*. In the preferred embodiment, the operator's seat faces the second end of the boom portion 15. Preferably, controls for operating the tools attached the boom portion 15, such as the poleclaw and the auger, are disposed in a control panel 60 to the operator's left. To the operator's right, is boom control means 65. In the preferred embodiment, the boom control means 65 include a handle member or lever portion 66 mounted at one end 68 to the digger derrick. The free end 70 extends generally forward in the direction the operator typically faces when seated.

Alternatively, as noted above, the operator's station may be remote from the rotating assembly such that the operator stands or sits in a position that does not move with a the boom. Control system according to the present invention are adapted for use with both stationary and rotational turret-type operator station arrangements.

Handle or lever 66 is mounted such that it is capable of motion in at least four manners or fashions. That is, the handle is mounted such that it is moveable along four paths of motion between two extreme positions. It should be understood that the handle may be positioned anywhere along the path of motion. That is, the handle is not required to be positioned only at the extreme positions.

Figure 2:
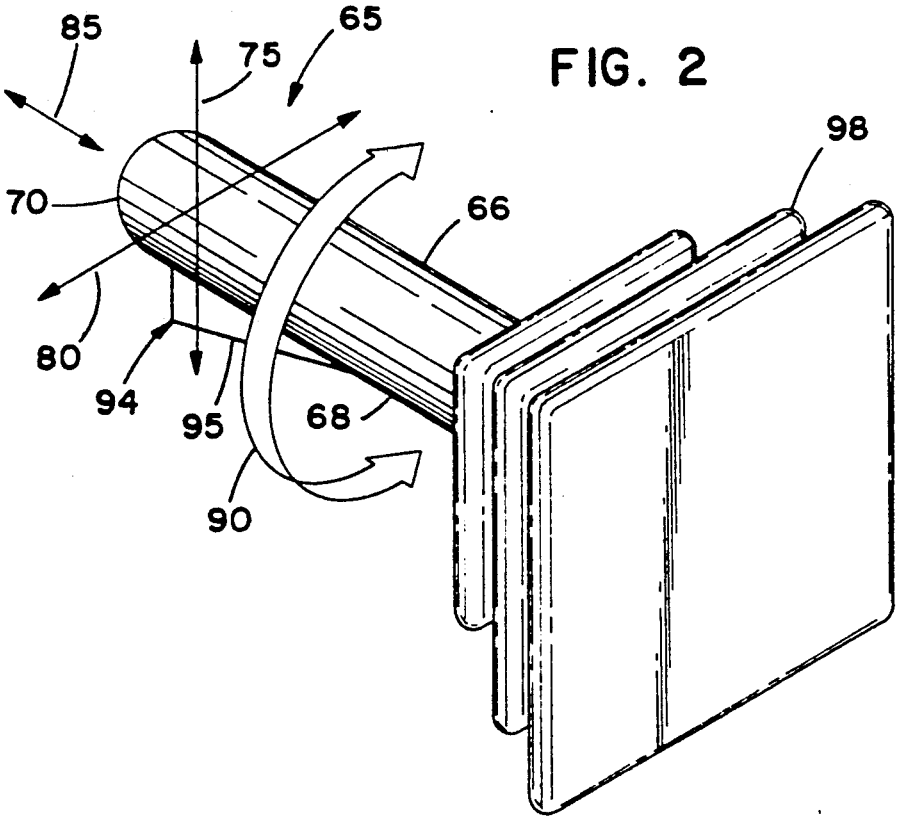
FIG. 2 is a perspective, fragmentary, schematic view of a handle according to the present invention, including arrows indicating the directions in which the handle is movable.

With reference to a preferred embodiment shown in FIG. 2, it can be understood that preferred handle 66 is capable of four motions. First, the handle is movable, i.e. pivotable, in an up/down direction as indicated by arrow 75. (As described in greater detail below, this up/down motion is not linear, but rather is arcuate, with end 68 of the handle or lever being pivotally mounted.) Second, the handle 66 is mounted for side-to-side path of motion as illustrated at arrow 80. (Once again, it will be understood from the discussion below, that this side-to-side motion is arcuate rather than linear in the preferred embodiment.) Third, the handle is movable in an in/out direction or path of motion as illustrated at arrow 85. (As described below, this motion is somewhat arcuate, although a portion of the motion is linear.) The fourth path of motion of the handle is a twisting motion as illustrated by arrow 90; i.e. the handle rotates about its longitudinal axis.

As noted above, the handle is moveable along each of the four paths of motion between two extreme positions along each path. Between each pair of associated extreme positions lies a central or neutral position.

The handle 66 includes means 94 for activating a safety actuator or dead-man switch. In the preferred embodiment, this safety actuator 94 is a squeeze trigger 95. The handle 66 is mounted to a console to the right of the operator's seat with a flexible bellows wall 98 covering the joint and allowing movement of the handle with respect to the console. This arrangement is illustrated in FIG. 1*c*.

Figure 3:
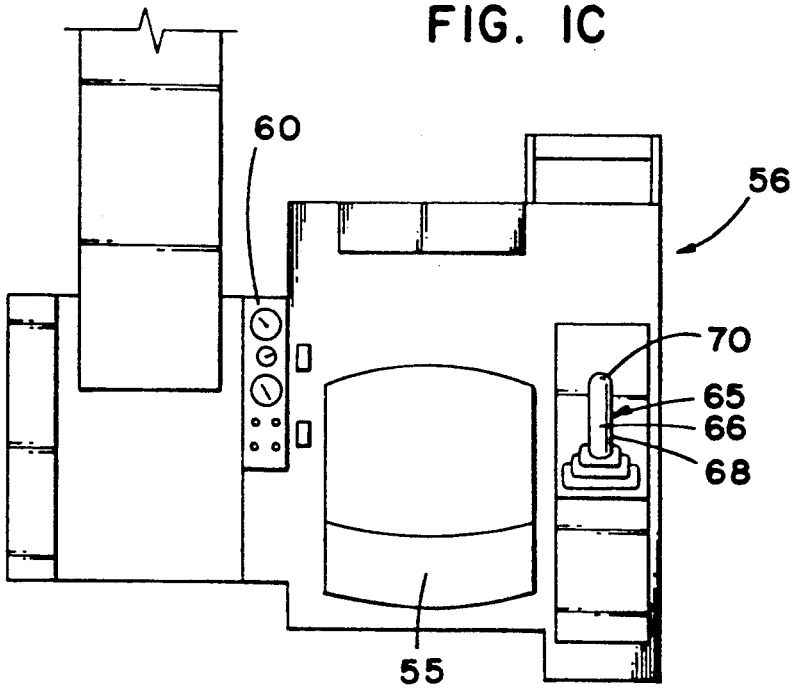
FIG. 3 is a chart showing correspondence between movement of a handle control means according to the present invention with movement of a boom of a digger derrick as shown in FIG. 1*a;*
Figures 4, 5, 6:
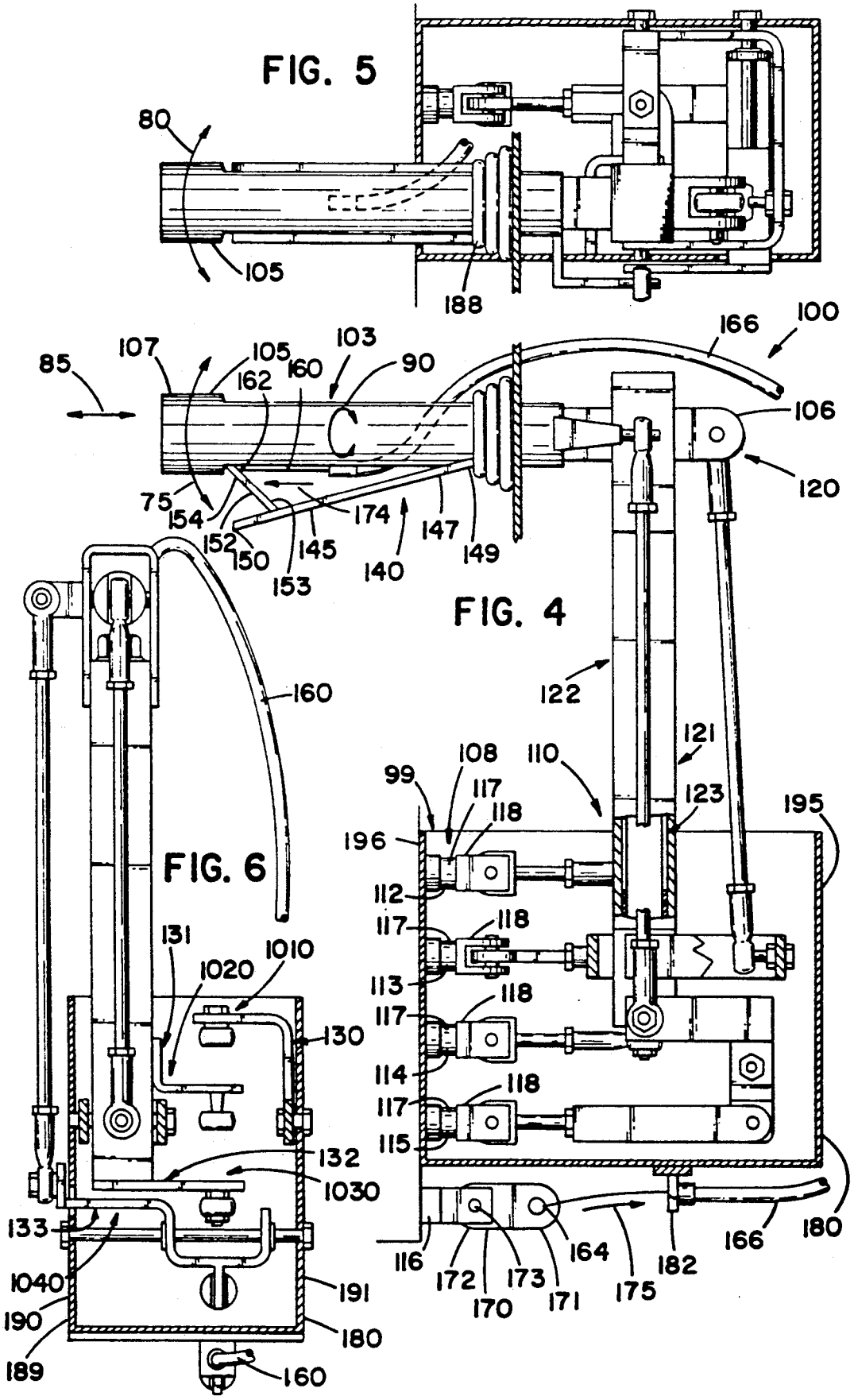
FIG. 4 is a cross-sectional, fragmentary, side view of a control system according to the present invention, with portions broken away to show internal detail.
FIG. 5 is a cross-sectional, fragmentary, top view of the control system shown in FIG. 4, with portions shown in cutaway.
FIG. 6 is a cross-sectional, fragmentary, right side view of the control system illustrated in FIG. 4.

The handle 66 is connected to four equipment activation means 99, FIG. 4. (In the preferred embodiment, activation means 99 includes hydraulic open center valves **99*a*, 99*b*, 99*c*, and 99*d* and means for controlling the valves, described in greater detail below.) Each of the equipment activation means 99*a–d* controls the operation of one of the movement functions. Each of the four handle movements corresponds to one activation means 99*a–d* and thereby corresponds to one movement function. FIG. 3 illustrates a preferred correspondence. The up/down handle motion 75 causes the boom 15 to move through arc 25. The side-to-side handle motion 80 causes the boom 15 to rotate through arc 30. In/out motion 85 of the handle operates tele 1 motion indicated at arrow 44. Finally, twisting motion of the handle in the direction of arrow 90 operates the motion of tele 2 indicated at arrow 49 to extend the boom 15. In this manner, the direction of movement of the handle generally mimics or parallels or moves analogously to the movement of the boom 15. For instance, moving the handle in an upward motion (arrow 75) results in a generally upward motion 25 of the boom 15; downward motion along arrow 75 results in a generally downward motion along 25 of the boom 15. Movement of the handle to the right of the operator results in movement of the boom 15 generally to the right; movement of the handle to the left of the operator results in movement of the boom 15** to the left of the operator. Inward movement of the handle results in contraction of the boom (tele 1); outward movement of the handle results in extension of the boom. The twisting motion is perhaps least similar to the resulting boom motion. Thus, it may be advantageous to employ the twisting motion to activate the boom motion least frequently used. In the embodiment shown, the tele 2 motion is associated with the second extension motion.

Turning now to the means by which the handle is connected to and translates motion to the activation means 99 controlling the movement functions, FIGS. 4, 5 and 6 provide side, top, and right side views, respectively, of the control system of the present arrangement. The control system is generally designated with reference numeral 100. Control system 100 includes a handle member 105, equipment actuation means 99 and means 110 for translating motion between the handle member 105 and the equipment activation means 99.

More specifically, the equipment actuation means 99 preferably includes a valve arrangement 108 having four valves: first valve 112 (associated with means for moving the boom 15 up and down); second valve 113 (associated with rotating the boom 15); third valve 114 (associated with means for producing tele 1 motion for extending the boom 15); and fourth valve 115 (associated with means for causing tele 2 motion to further extend the boom 15). The preferred valve arrangement 108 is a Gresen V-12 hydraulic valve. Valve control means control the opening and closing of each valve. The valve control means of each valve includes a sleeve-like sliding connector portion 117 that is mounted on a shaft-like member 118 for sliding displacement thereon. Each connection portion 117 is movable between first and second extreme positions in which the valve is fully open. A central position, or neutral position, is located between the two extreme positions and the valve is biased, such as by a spring arrangement, to its neutral position. In the neutral position, the valve is closed and does not permit fluid flow therethrough. Between the central position and one extreme end position, the valve opens progressively, to allow variable fluid flow through a first channel; between the central position and the other extreme end position, the valve opens progressively, to allow variable fluid flow through a second channel. Thus, the valve can be actuated without it being at its extrememost positions. Further, the different sides of the valve may be used to control different movements. Preferably, opening of one side of the valve causes a certain resulting motion of the equipment in one direction along one path of motion, and opening the other side of the valve causes certain resulting motion of the equipment in the opposite direction along the same path of motion. For instance, one side of a valve may affect upward movement of the associated equipment, and the second side of the valve may affect downward movement. Such valves are known in the operation of, for instance, hydraulic lifting, construction, and manufacturing equipment.

As noted above, both the handle and the valves have two extreme positions and a central, neutral position. Further, as explained above, operation of the handle along one particular path of motion affects the movement of one valve associated therewith and consequently causes movement of the boom along one path of motion. Movement of the handle away from its central position to one extreme position causes the movement of an associated valve towards one extreme position, thereby causing movement of the boom in one direction along a corresponding path of motion. Because the valve is biased to its central or neutral position, ceasing to move the handle will cause the valve to assume its neutral closed position thereby stopping movement of the boom. This will be best understood with reference to a particular example. If an upward movement of the boom or other equipment is desired, the operator moves the handle upward. The upward movement of the handle pulls the corresponding valve toward an extreme position and thereby activates the structural mechanism that lifts the boom. When the boom reaches the desired elevation, the operator can cease moving the handle upward, and the valve will assume its neutral, closed position, and the boom will cease to move upward.

In an alternate embodiment, electronic actuation is contemplated for the equipment actuation means instead of the hydraulic valve arrangement. For instance, Potentrometer or LVDT electronic actuators may be used. As with the valve arrangement, the electronic actuator would include means to bias the actuator in a neutral position.

Means 120 are provided for moving the handle through arc 75 (or in an up/down fashion). Means 121 are provided for moving the handle member 105 in the direction indicated by arrow 80. Means 122 are provided for moving the handle member 105 in the direction indicated by arrow 85. Finally, means 123 are provided for moving the handle member 105 in the direction indicated by arrow 90, FIG. 2 (in a twisting motion). Each of these means 120–123 will be described in detail below with reference to FIGS. 7–9. Each of the handle movement means 120–123 is constructed and arranged to allow each of the handle movement means to be operated independently to effect actuation of the associated equipment actuation means 99*a–d*. That is, means are provided to prevent movement of handle movement means 120, 121, 122 and 123, from causing undesired activation of any of the equipment actuating means other than the equipment actuations means with which the handle movement means is associated. This will be discussed further below. For instance, handle movement means 120 will preferably, substantially only affect movement of valve 112. This arrangement will be discussed in greater detail below.

With further reference to FIGS. 4–6, control system 100 further includes means 130, 131, 132, 133 for translating motion from the handle member 105 to valves 112, 113, 114, 115, respectively, and consequently to equipment actuating means 99*a*, 99*b*, 99*c*, and 99*d*, respectively.

A more detailed description of each of means 130–133 for translating motion is provided below with respect to FIGS. 7–10, respectively.

With continued reference to FIG. 4, it can be understood that the control system 100 includes a safety actuator or dead-man switch arrangement 140. In the preferred embodiment illustrated in FIG. 4, the dead-man switch arrangement 140 includes a squeeze trigger 145 including a squeeze bar 147 having first and second ends 149 and 150, respectively. First end 149 is pivotally attached to the handle member 105. Free end 150 pivots in an arc around end 149 when it is squeezed. A slider bar 152 has first and second ends 153 and 154, respectively. First end 153 is attached to squeeze bar 147. End 154 is attached to the handle member 105 by a sliding joint. Cable 160 is attached at end 162 to end 154 of slider bar 152. The opposite end of the cable 160 is at 164. The cable 160 passes through a cable cover 166 through a portion of its length. Cable end 164 is fixed to a link 170. Link 170 includes first and second ends 171 and 172, respectively. Cable end 164 attaches to link 170 at end 171. Link end 172 attaches to valve 116. In typical use, upon pulling squeeze trigger 45, squeeze bar 147 pivots toward the handle member 105. End 154 of slider bar 152 slides toward the free end 107 of the handle arrangement, thereby pulling the cable 160 in the direction indicated by arrow 174. In this manner, link 170 is pulled in the direction of the tension supplied by cable 160, thereby moving the valve 116 to the right, as presented in the orientation of FIG. 4 and illustrated by arrow 175. Link 170 is attached to valve 116 at a pin joint 173. Valve 116 is spring loaded, such that valve 116 is biased to the left, in a closed position, until squeeze trigger 145 is operated. When squeeze trigger 145 is not operated, the safety actuator prevents fluid from flowing through any of the valves 112–115. When squeeze trigger 145 is operated, the safety actuator allows, but does not cause or require, fluid to flow through any of the valves 112–115.

Valves 112–115, and portions of means 120–123 and means 130–133 are located within a support housing 180. This housing 180 is mounted to, or within, the console 181. Preferably, a flexible bellows 188, FIG. 5, covers the linkages of the control system, such that only the handle member 105 is exposed. The housing 180 is a generally rectangular box 189 in the embodiment shown in FIGS. 4–6. The box 189 includes two generally parallel side walls 190, 191, FIG. 6, and a front wall 195, FIG. 4, extending between the side walls 190, 191. The valves 112–115 extend forward from a back wall 196 which may be a portion of the valve casing. That is, a wall of the valve casing from which the valve shafts 118 extend may form the back wall of the housing 180. In a preferred embodiment this housing 180 is preferably less than one cubic foot in volume. It should be understood that this volume dimension is merely exemplary of a preferred embodiment and are in no way limiting to the invention.

Cable 160 is supported by a bracket 182 extending outwardly from the housing 180, FIG. 4.

Figure 7B:
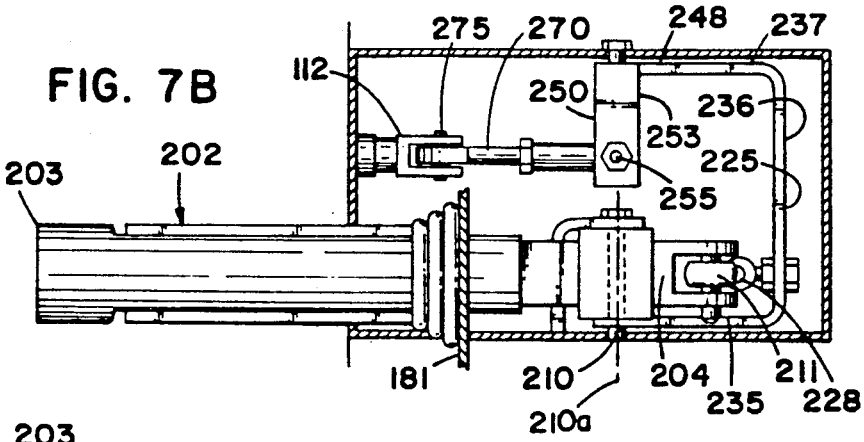
FIG. 7*b*is a cross-sectional, fragmentary, top view of the linkage illustrated in FIG. 7*a;*
Figure 7C:
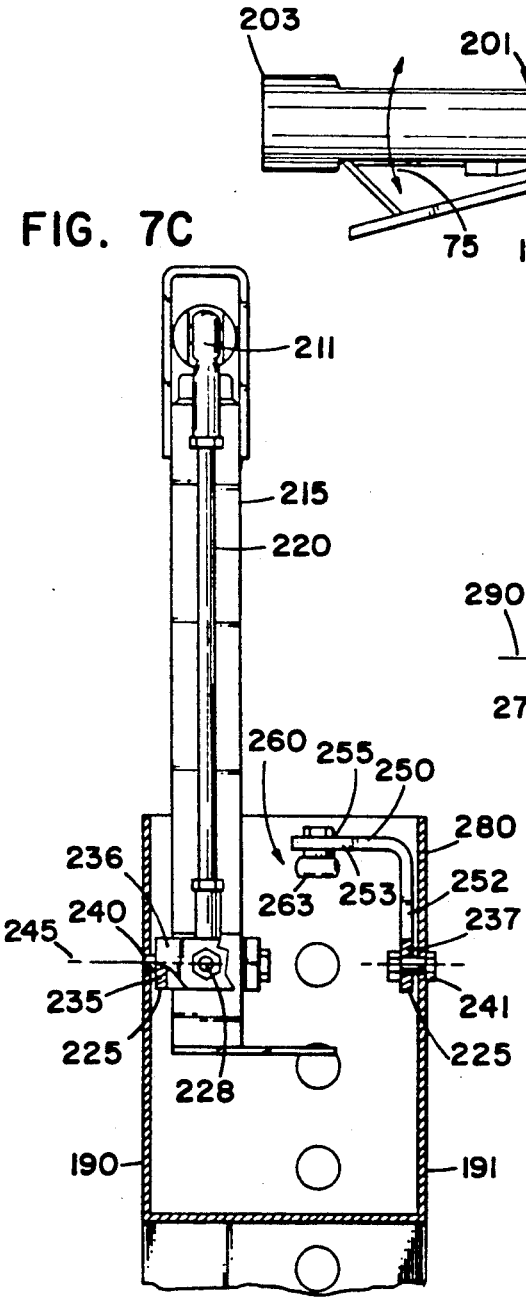
FIG. 7*c* is a cross-sectional, fragmentary, right side view of the linkage illustrated in FIG. 7*a;*
Figure 7A:
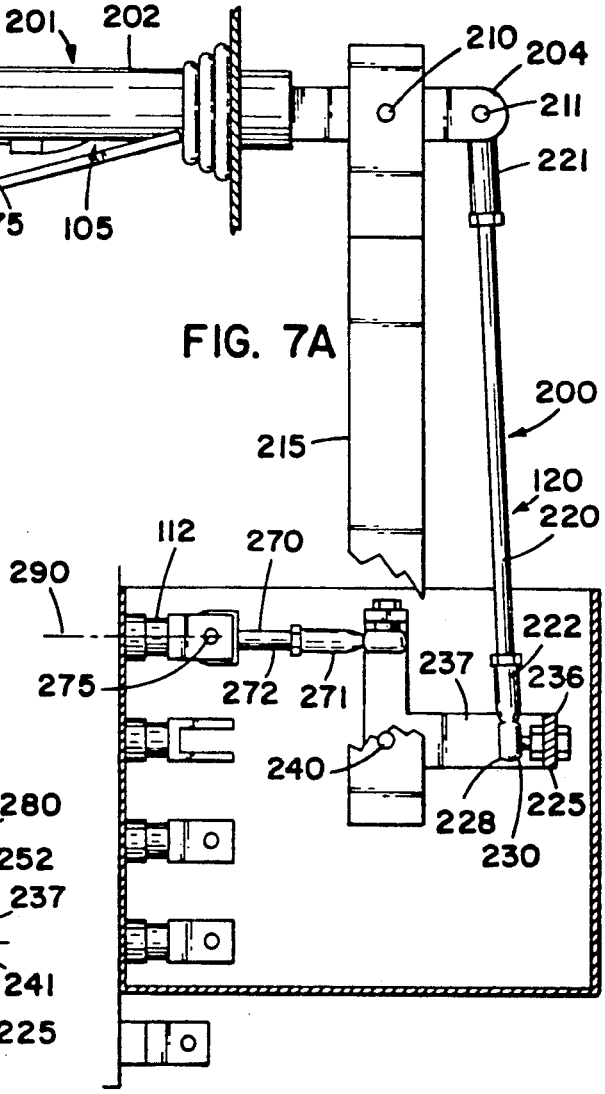
FIG. 7*a* is a cross-sectional, fragmentary, side view of a portion of a linkage in a control system for controlling one movement function of the control system as illustrated in FIG. 4 with portions broken away to show internal detail.

Turning now to FIGS. 7*a*–7*c*, it can be understood that the means 120 for moving the handle in the direction of arrow 75 and the means 130 for translating motion from the handle member 105 to the valve 112 is shown. That is, those portions of the control system shown in FIGS. 4–6 that relate to movement of the handle member 105 in the direction of arrow 75 are illustrated; other portions of the control system are omitted for clarity. It further illustrates means 130 for translating motion from the handle member 105 to valve 112. Activation of valve 112 results in the activation of means 120 for moving the boom 15 in an up/down direction (see FIG. 1*a*, arrow 25). In the preferred embodiment, a linkage arrangement 200 allows handle member 105 to move in the direction indicated by arrow 75 and translates motion from the handle to valve 112. Linkage 200 includes the handle 202 having a first end 203 at which the operator grips the handle, and a second end 204 opposite the first end 203. Between first and second ends 203 and 204, lie first and second pin joints 210 and 211. Pin joint 210 is best illustrated in FIG. 7*b*. Handle 202 is pivotally attached to a fulcrum member 215 which, in the orientation shown in FIG. 7*a*, is upright or vertical.

A second link member of linkage arrangement 200 is support bar 220. Support bar 220 has first and second opposite ends, 221 and 222, respectively. Support bar first end 221 is attached pivotally to handle 202 at second pin joint 211. Support bar 220 is attached at its second end 222 to a generally U-shaped swinging member 225. The preferred joint 228 between support bar second end 222 and swinging member 225 is a ball and socket joint 230, as will be described in greater detail below. Swinging member 225 is generally U-shaped. Swinging member 225 is illustrated in perspective in FIG. 7*d*. Swinging member 225 includes a first side leg 235, a second front leg 236 and a third side leg 237. Legs 235 and 237 are generally parallel to one another in the preferred embodiment. Leg 236 extends therebetween and is generally perpendicular to each side leg 235, 237. The three legs 235, 236, and 237 are preferably coplanar. Referring now to FIG. 7*c*, it can be understood that leg 235 is attached to the left side wall 190 of the housing 280 at joint 240. Leg 237 is pivotally attached to the right side wall 191 of the housing 280 at joint 241. Thus, leg 236 is generally, approximately, somewhat less than the width of the front wall of the housing 280. Joints 240 and 241 are aligned and lie along an axis 245. Joints 240 and 241 include bushing arrangements which allow swinging member 225 to pivot as a whole about axis 245. This can be understood with reference to FIG. 7*d* as well. The end of leg 237 opposite second front leg 236 is indicated at reference numeral 248. Extending vertically from end 248 is an actuator member 250. Actuator member 250 may be integral with or fixed to swinging member 225. Actuator member 250 includes an upright portion 252 and a horizontal portion 253. Horizontal portion 253 includes a free end 255. Free end 255 includes a joint arrangement 260 which preferably includes a ball and socket joint 263. Joint arrangement 260 joins free end 255 of actuating member 250 to a rod 270, as illustrated in FIG. 7*a*. Rod 270 includes first and second ends 271 and 272. First end 271 engages free end 255 of the swinging member 225 at the joint arrangement 260. Second end 272 of rod 270 is attached to valve 112 at pin joint 275.

Figure 7D:
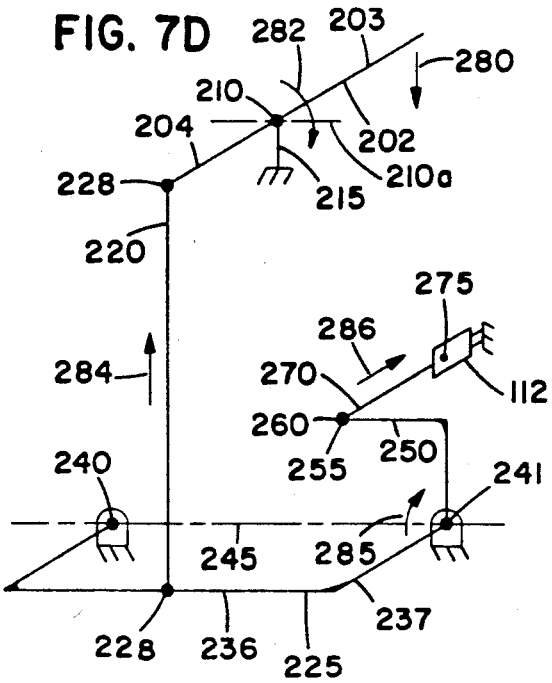
FIG. 7*d* is a schematic of an example of motion of the linkage illustrated in 7*a*–7*c;*

The movement of linkage arrangement 200 is illustrated schematically in FIG. 7*d*. To operate the boom 15 in an up/down motion, as illustrated in FIG. 1*a* at arrow 25, it is necessary to activate valve 112. To do so, the operator applies either an upward or downward force as desired to the handle 202. In FIG. 7*d*, for example, a downward force is applied. A downward force at free end 203 on handle 202, causes handle 202 to rotate about pin joint 210. The downward force is indicated at arrow 280. The rotation of handle 202 about pin joint 210 is illustrated at arrow 282. As end 203 of handle 202 moves downward, the opposite end 204 of the handle 202 moves upward. Similarly, support bar 220 which is connected at handle 202 at pin joint 228, also moves upward as indicated at arrow 284. As support bar 220 moves upward, it pulls front leg 236 of swinging member 225 in an upward direction. This causes swinging arm 225 to swing or pivot about joints 240 and 241, or axis 245. Thus, as front leg 236 moves upward, actuator member 250 moves in an arc 285 about axis 245. The resulting motion is generally in a backward direction as indicated by arrow 286; in other words, the actuator member 250 generally moves toward valve 112. As actuator member 250 moves backward as illustrated by arrow 288, free end 255 of actuator member 250 moves backward as well. Rod 270, attached to end 255 at joint 260, is pushed generally toward valve 112, thereby pushing the valve connector portion 117 backward, towards its innermost extreme position.

In this manner, the motion of handle 202 in an upward and downward direction, effects actuation of valve 112.

A second movement function of the digger derrick is a rotation movement as illustrated at arc 30 in FIG. 1*a*. The linkage arrangement 300 for effecting the rotation of the boom 15 is illustrated in FIGS. 8*a–d*. Linkage arrangement 300 includes handle 302 having a first end 303 and a second end 304. First end 303 is free, and extends from the console. It is therefore exposed and is grasped by the operator in use. The second end 304 of handle 302 is attached to shaft 310 which is in a vertical position in FIG. 8*a*. Concentric with and inside shaft 310 is a second internal shaft 315. Internal shaft 315 includes an upper narrow portion 317 that is circular in cross-section, and a lower portion 320 that is preferably square in cross-section and generally greater in diameter that the upper portion 317. Thus, a shoulder 322 is located on top of the lower portion 320. Upper portion 317 is integral with lower portion 320. Bushings 325 and 326 are provided on internal shaft 315 to allow external shaft 310 to rotate about its axis and relative to internal shaft 315. That is, while internal shaft 315 may remain stationary, external shaft 310 can rotate about their common axis 313. A pin 330 is fixed to the housing and extends through the lower portion 320 of internal shaft 315. Pin 330 extends along an axis 331 that is collinear with axis 225, discussed above.

Turning to FIG. 8*c*, it can been seen that an L-shaped bracket 335 is integral with or fixed to external shaft 310. L-shaped bracket 335 includes first and second ends 336 and 337, respectively. End 336 is fixed to external shaft 310. At second end 337, L-shaped bracket 335 is attached through a joint arrangement 340 to a rod 345 at a first end 346 of the rod. A second end of the rod 347 is attached through another joint arrangement 350 to valve 113.

Figure 8D:
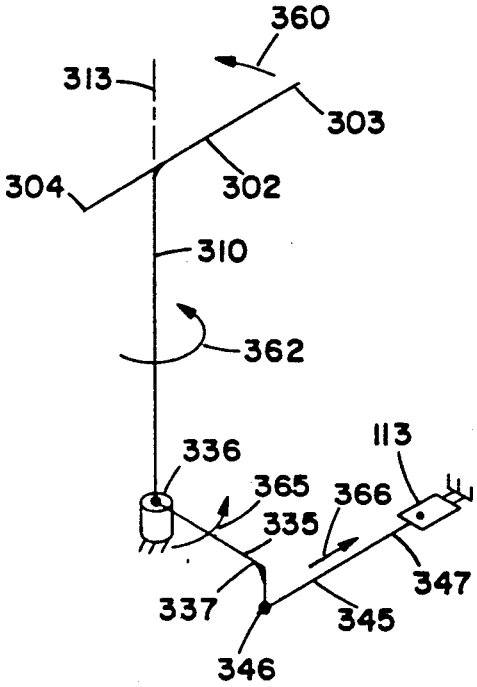
FIG. 8*d* is a schematic of an example of motion of the linkage illustrated in 8*a*–8*c;*

The operation of linkage arrangement 300 can be understood with reference to FIG. 8*d*. As handle 302 is rotated about axis 313, such as as a result of a force applied in the direction of arrow 360, external shaft 310 rotates about axis 313 as well since it is integral with or connected to handle 302. L-shaped bracket member 335, which lies generally perpendicular to the plane defined by handle 302 and shaft 310, rotates about axis 313 with shaft 310 to which it is fixed. Bushings 325 and 326 allow external shaft 310 to rotate relative to internal shaft 315 in the direction indicated by arrow 362. (Internal shaft 315 is precluded from rotating about axis 313 because of pin 330 extending through the lower portion 320 of internal shaft 315.) That is, bracket 335 moves through the arc indicated at arrow 365. Thus, end 337 of bracket 335 similarly traverses an arc about the vertical axis 313. As the end 337 moves backward in the housing in the direction indicated by arrow 366, or toward from the valve 113, the rod 345 pushes on valve 113 to move it to its innermost extreme position.

It should be noted that joint arrangement 340 lies on a horizontal axis 370 collinear with the horizontal axes 245 and 331 described above with respect to the linkage arrangement 200.

A third handle movement means 123 causes a first extension of the boom 15, in the direction illustrated at arrow 44 in FIG. 1*a*. Linkage arrangement 401 illustrated in FIGS. 9*a–9d* allows handle 402 to move and to translate motion to valve 114. Handle 402 includes a first end 403 and a second opposite end 404. Intermediate first and second ends 403 and 404, handle 402 is fixed to shaft 410 at a first end 412 of the shaft. At a second opposite end 413, as illustrated in FIG. 9*c*, shaft 410 is mounted for rotation about pin joint arrangement 420. That is, pin joint 420 passes through second end 413 of shaft 410 along axis 422. Axis 422 is collinear with axis 245, discussed above, with respect to FIG. 7*c* and FIG. 8*c*.

An actuator member 430 is fixed to second end 413 of shaft 410. Actuator member 430 has a first end 431 which is fixed to shaft 410. A second opposite end 432 includes a joint arrangement 440, which in a preferred embodiment includes a ball to be received in a socket of a ball and socket joint. As shown in FIG. 9*b*, a rod 445 is connected to actuator member 430 at joint arrangement 440. Rod 445 includes means 50 for attaching to the joint arrangement 440 on actuator member 430. In the preferred embodiment, attachment means 450 includes a socket for receiving a ball in the joint arrangement 440. Rod 445 includes a first end 446 and a second opposite end 447. Rod 445 is attached at first end 446 to actuator member 430. At its second opposite end 447, rod 445 is pivotally attached to valve 114.

Figure 9D:
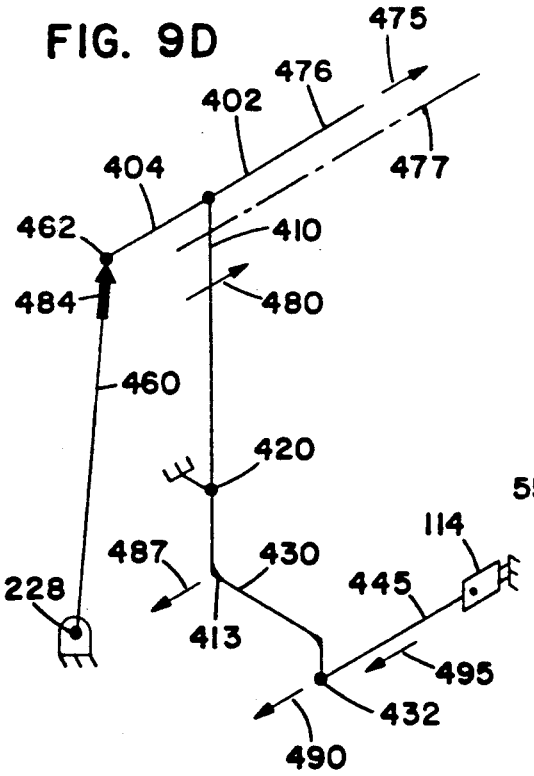
FIG. 9*d* is a schematic of an example of motion of the linkage illustrated in 9*a*–9*c;*
Figure 9B:
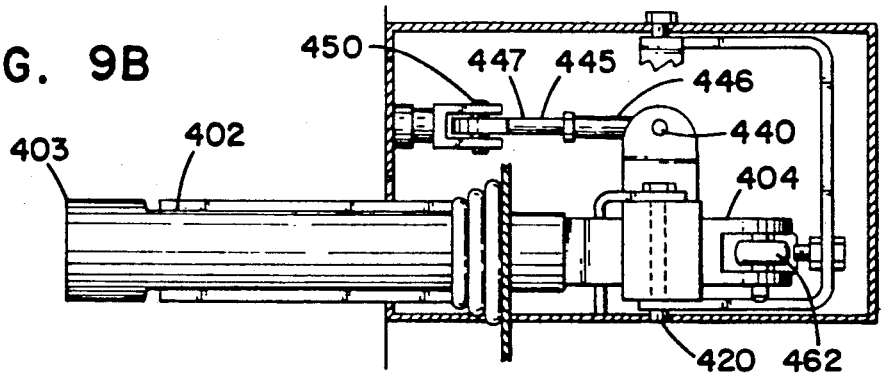
FIG. 9*b* is a cross-sectional, fragmentary, top view of the linkage illustrated in FIG. 9*a;*
Figure 9C:
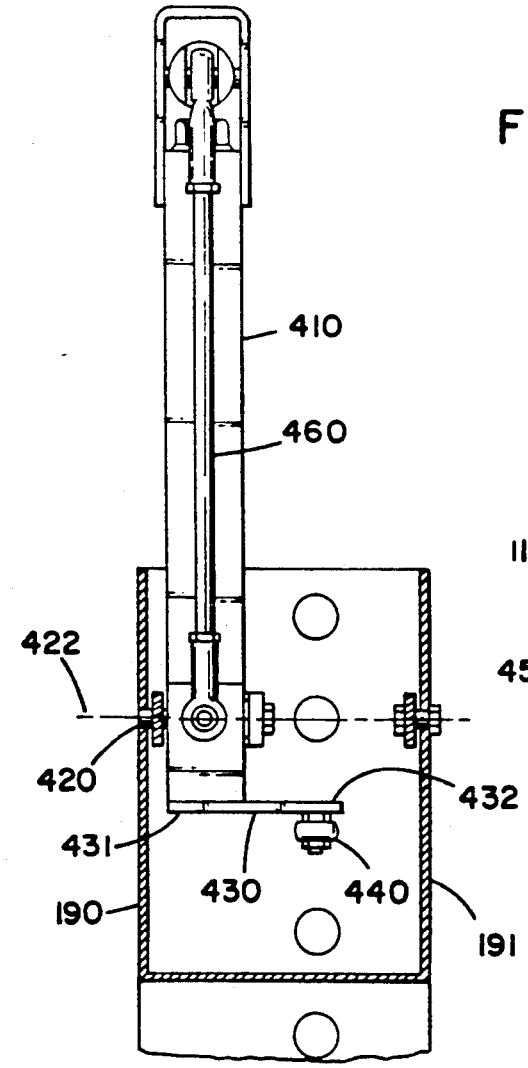
FIG. 9*c* is a cross-sectional, fragmentary, right side view of the linkage illustrated in FIG. 9*a;*
Figure 9A:
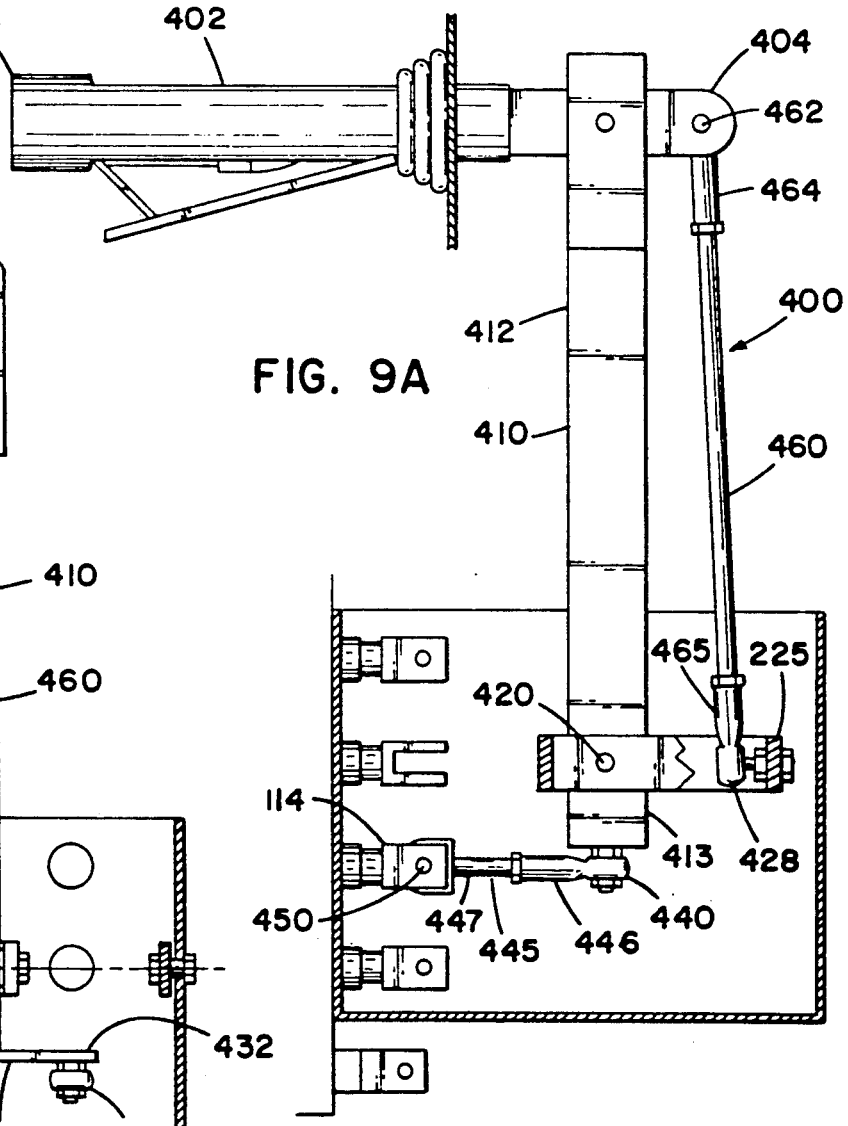
FIG. 9*a* is a cross-sectional, fragmentary, side view of a portion of a linkage in a control system for controlling one movement function of the control system as illustrated in FIG. 4, with portions broken away to show internal detail.

As can be seen from FIG. 9*a*, second handle end 404 is pivotally attached to support bar 460 at pivot joint 462. Support bar 460 includes first and second opposite ends 464 and 465. First end 464 is pivotally attached to support bar 460. Second opposite end 465 is attached to a U-shaped swinging member 225 at joint 228. Joint 228 precludes handle 402 from rotating with respect to any point on handle 402. That is, handle 402 remains generally horizontal as handle 402 is moved in the in/out direction as indicated by arrow 85 in FIG. 2 unless a force tangential to the end 403 is exerted on end 403 of handle 402 to activate the boom up/down movement function.

The movement of linkage arrangement 400 will be understood with reference to FIG. 9*d*. The operator exerts a force on the handle in the direction of arrow 475. Handle 402 and shaft 410 then rotate about axis 422 through pin joint 420. As handle 402 is pulled in the direction of arrow 475, shaft 410 rotates in a direction indicated by arrow 480 about pin joint arrangement 420. Support bar 460 effectively exerts a force in the direction indicated by arrow 484 at end 404 of handle 402 to prevent rotation of handle 402 with respect to a horizontal axis.

As shaft 410 rotates about pin joint arrangement 420, second end 413 of shaft 410 rotates in the direction indicated by arrow 487. Similarly, actuating member 430 rotates in the same manner with respect to pin joint 420. Thus, end 432 moves through the arc indicated at arrow 490. This causes rod 445 to move in the direction indicated by arrow 495 thereby actuating valve 114.

The fourth movement function of the boom 15 is a second telescoping extension as indicated by arrow 49 in FIG. 1*e*. This movement is governed by a twisting motion of the handle 402 as indicated at arrow 90 in FIG. 1*a*. This movement is allowed by the linkage arrangement 500 illustrated in FIGS. 10*a*, 10*b*, 10*c* and 10*d*. Linkage arrangement 500 includes a handle arrangement 501. Handle arrangement 501 includes an interior handle portion 504 and an external handle portion 506. Internal and external handle portions 504 and 506 are coaxial, with their shared axis indicated at reference numeral 508. Handle portion 506 has a first end 510 and a second opposite end 511 External handle 506 is mounted on internal handle 504 by means of a bushing, for instance, which allows external handle 506 to rotate about axis 508 and relative to internal handle portion 504. That is, external handle portion 506 is rotatably mounted independent of internal handle portion 504. At external handle portion second end 511, external handle portion 506 is fixed to a sleeve 515 which extends through the flange 517 which secures the handle arrangement 501 to the console 181. Sleeve 515 is fixed, such as by welding to an L-shaped rod 520, as illustrated in FIG. 10*b*. L-shaped rod 520 has a first end 521 and a second opposite end 522. First end 521 is fixed to sleeve 515. Second opposite end 522 includes a joint arrangement 525. In the preferred embodiment, joint arrangement 525 is a ball and socket arrangement, the ball 530 being disposed on end 522 of rod 520.

Figure 10D:
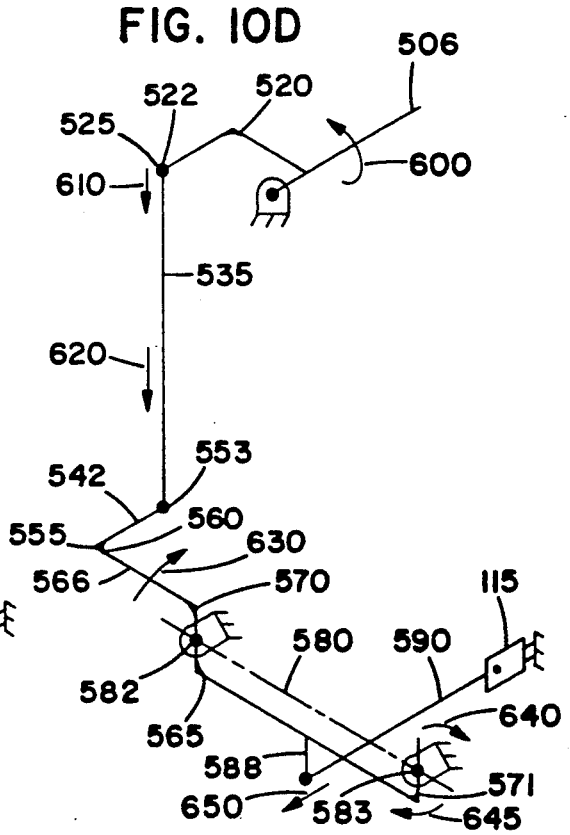
FIG. 10*d* is a schematic of an example of motion of the linkage illustrated in 10*a*–10*c;*
Figure 10B:
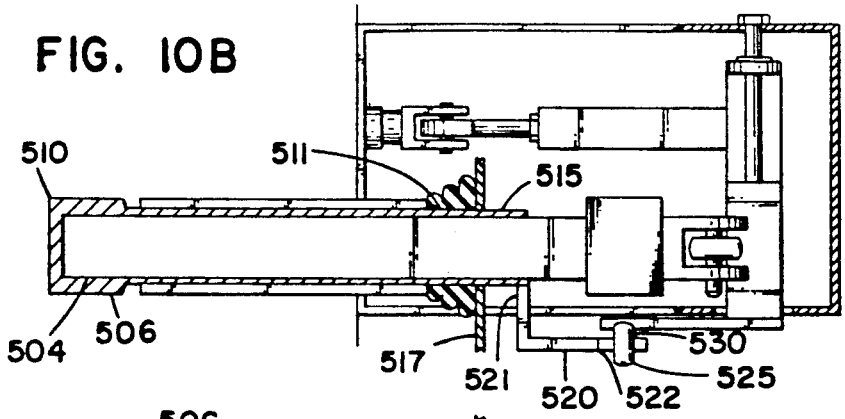
FIG. 10*b* is a cross-sectional, fragmentary, top view of the linkage illustrated in FIG. 10*a;*
Figure 10B:
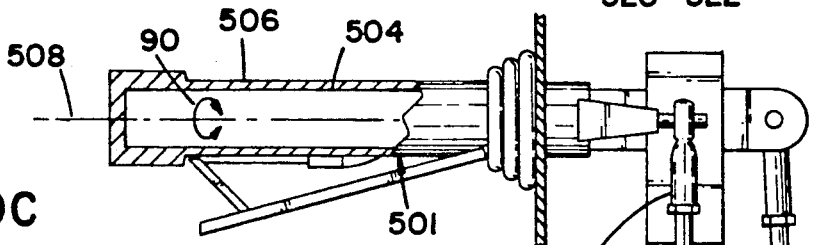
Figure 10C:
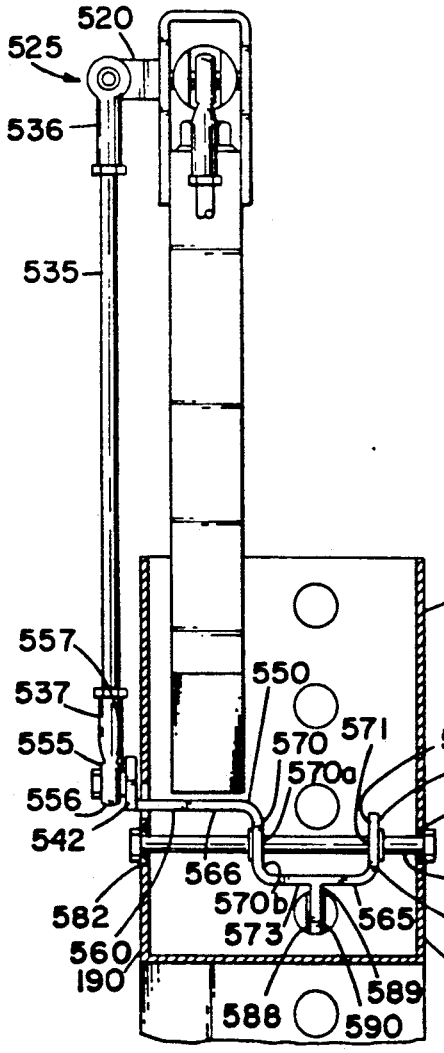
FIG. 10*c* is a cross-sectional, fragmentary, right side view of the linkage illustrated in FIG. 10*a;*
Figure 10A:
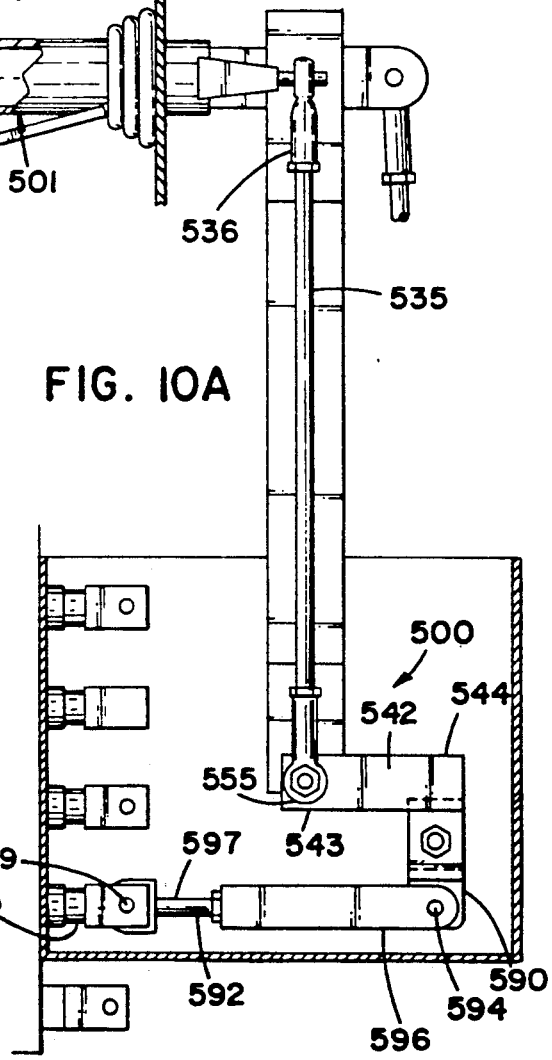
FIG. 10*a* is a cross-sectional, fragmentary, side view of a portion of a linkage in a control system for controlling one movement function of the control system as illustrated in FIG. 4, with portions broken away to shown internal detail.

As illustrated in FIG. 10*c*, support member 535 is pivotally attached to rod 521 through joint arrangement 525. In the preferred embodiment, rod 535 includes a socket 540 for receiving ball 530. Support member 535 has first and second opposite end 536 and 537. Support rod 535 is connected to the L-shaped rod 520 at the first end 536 of the support member. At the second opposite end 537 of the support member 535, the support member 535 is connected to a connecting member 542. Connecting member 542 has first and second opposite ends 543, 544, and is attached at its second end to an actuator member 550 through a joint arrangement 555. Joint arrangement 555 is preferably a ball and socket joint, with the socket 556 is disposed on the second end 537 a support member 535. The ball 557 of joint arrangement 555 is located on a first end 560 of actuator member 550. Actuator member 550 extends through the left side wall of the housing 180. Housing 180 includes a slot or opening to accommodate actuator member 550. Actuator member 550 is shaped somewhat like the Big Dipper constellation. That is, it includes a U-shaped dipper portion 565 and a handle portion 566 attached to and extending therefrom. Handle portion 556 is located proximate said first end 560 of actuator member 550. Dipper portion 565 is located proximate a second opposite end 568 of actuator member 550. Dipper portion 565 is generally U-shaped, with two leg portions 570 and 571 that are generally parallel and that extend vertically in the orientation shown in FIG. 10*c*. An arm portion 573 extends between the leg portions 570 and 571. A shaft 580 extends through leg portions 570 and 571 and through the side walls of the housing 180. Shaft 580 divides each leg portion 570, 571 into upper and lower portions 570*a*, 570*b*, and 571*a*, 571*b*. Bushings 582 and 583 allow actuator member to pivot about shaft 580. An extension member 588 extends downwardly from the center of arm portion 273. Extension member 588 includes a first end 589 attached to arm portion 573 and a second end 590 opposite first end 589. As can be seen from FIG. 10*a*, second end 590 is attached to rod 592 by a pin joint 594. At a first end 596 of rod 592. At a second opposite end 597 of rod 592, rod 592 is attached to valve 115 by a pin joint 599.

Movement of linkage arrangement 500 can be understood with reference to FIG. 10*d* in which linkage arrangement 500 is illustrated schematically. To operate the second extension of the boom 15, or the tele 2 movement function, external handle portion 506 is rotated about its longitudinal axis as indicated at arrow 600. This causes L-shaped rod 520, which is fixed to external handle portion 506, to rotate about the axis of handle portion 506, such that end 522 of rod 520 moves in a downward fashion as illustrated at arrow 610. Rod 535, which is attached to rod 520 at ball joint arrangement 525, similarly moves in a downward direction as indicated at arrow 620. The movement of connecting member 542 is generally in downward direction as well, but also rotates somewhat about ball joint 555. Handle 566 rotates in the direction indicated by arrow 630. More specifically, it is driven by the force supplied by the connector member at ball joint 55 to end 560 of the handle 566. It moves in an arc 630 about an axis through shaft 580 because of the mounting of the actuator member 550 on shaft 580 at joints 570 and 571. The upper portions 570*a*, 571*a* of leg portions 570 and 571 rotate in a direction indicated by arrow 640. Similarly, the lower portions 570*b*, 571*b* of legs 570 and 571 rotate in the direction indicated by arrow 645 this causes the end of extension member 588 to pull rod 590 in the direction indicated by arrow 650. Rod 590 in turn operates valve 115.

As noted above, the handle movement means are constructed and arranged to cooperate such that each can be operated independently or in conjunction with any of the others. For instance, linkage arrangement 200 includes means 1000 for preventing handle movement means 120 from affecting movement of any valves 113, 114, 115 other than valve 112. Similarly, linkage arrangement 300 includes means 1010 for preventing handle movement means 121 from affecting movement of any valves 112, 114, 115 other than valve 113. Linkage arrangement 400 includes means 1020 for preventing handle movement means 122 from affecting movement of any valves 112, 113, 115 other than valve 114. Linkage arrangement 500 includes means 1030 for preventing handle movement means 123 from affecting movement of any valves 112, 113, 114 other than valve 115. Means 1000, 1010, 1020, 1030 include the arrangement of and alignment of joint arrangements in the system; for example, joint arrangements 240, 241, 420, 340 are generally aligned on a horizontal axis generally collinear with axis 225. Further, joint arrangements 260, 340, 440 and 594 are generally preferably vertically aligned.

Figure 11:
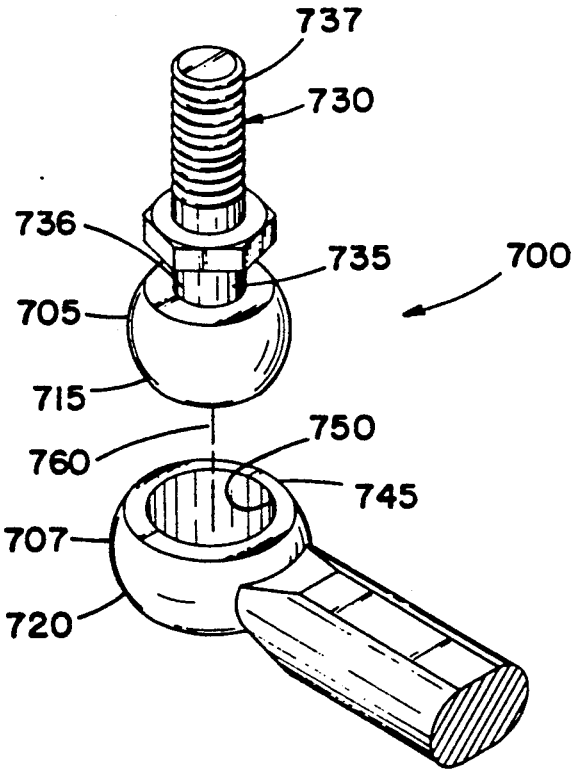
FIG. 11 is an enlarged, fragmentary, exploded view of a joint arrangement used throughout the control system shown in FIGS. 4–10.

With reference to FIG. 11, a number of joint arrangements described above are described as being ball and socket joints in the preferred embodiment of a control system according to the present invention. Such a ball and socket arrangement is illustrated in FIG. 11 and indicated generally at reference numeral 700. The ball and socket arrangement 700 includes a first mating member 705 and a second mating member 707. In the embodiment shown in FIG. 11, the first mating member 705 includes a ball 715, and second mating member 707 includes a socket 720. Typically, ball 715 will be disposed on and attached to the end of a rod member or bar or link in a linkage system. Typically, the connection between the ball and the end of a link or bar of the linkage system will be accomplished by welding or other conventional method of attachment such as by connection arrangement 730. Connection arrangement 730 includes a rod shaped extension 735 extending from ball 715. Extension 715 has first and second ends 736 and 737. End 736 is attached to or integral with ball 715. Second end 737 includes threads or the like for connection to a tapped link. Alternatively, second end 737 may be cylindrical or hollow, with the interior surface being tapped to receive a threaded end of a rod or link.

Socket 720 includes an outer housing 745 circumscribing an inner cavity 750 which is sized and shaped to receive ball 715 therein. The ball 715 is received in cavity 750 in such a manner that ball 715 may rotate freely in all directions within cavity 750. Preferably, cavity 750 is lined with polyethylene to reduce friction between the ball and socket. Such a lining reduces the need for lubrication which is disadvantageous because it holds dirt and particles which can hinder the movement of the ball within the joint and may scratch the mating surfaces.

Motion is translated from a link connected to ball 715 to a link connected to socket 720 by applying a force that has a component that is directed radially outward from axis 760. Axis 760 passes through the center of outer housing 745. Because ball 715 is free to rotate within cavity 750, a link connected to ball 715 can move in any other direction without transmitting a force to the link connected to socket 720. That is, force, and motion, will only be translated from the link connected to ball 715 to the link connected to socket 720 when a radial force or an axial is applied. In other words, only those components of force in a radial direction or an axial direction will be translated from the ball to the socket or vise versa.

It is noted that bushings for use with the present invention are preferably nylon to avoid the need for lubricants which hold dirt and particles which can hinder movement of or damage connections.

Finally, it is noted that the present arrangement is advantageous because it incorporates relatively few cable-operated controls. Cable controls have a tendency to freeze up in extreme cold temperatures. Further, they have a tendency to rust relatively severely such that they must be replaced. The control system of the present arrangement incorporates linkages of bar-like members rather than cables which are less subject to freezing up in cold temperatures and are less affected by rust. Further, the bar-like members can be made of materials other than metal, such as relatively hard plastics, to further reduce rusting problems.

It is to be understood that even though numerous characteristics and advantages of the present invention have been set forth in the foregoing description, together with details of the structure and function of the invention, the disclosure is illustrative only, and changes may be made in detail, especially in manners of shape, size, and arrangement of parts within the principals of the invention to the full extent indicated by the broad general meaning of the terms in which the appendant claims are expressed.

What is claimed is:

1. Maneuverable equipment including a derrick having a telescoping boom, said boom being constructed and arranged to perform four movement functions including (1) rotating about an axis generally perpendicular to a surface on which the derrick sits; (2) rotating about an axis generally parallel to the surface on which the derrick sits; (3) extending a first boom portion; and (4) extending a second boom portion; the improvement comprising:

a control system including:

a) handle means mounted on said digger derrick for controlling said four movement functions; said handle means including an elongate handle member having first and second ends;

b) first handle movement means for moving said handle means in a first defined path of motion between first and second defined positions, said first path of motion being in a first plane; and said handle member being mounted at a first pivot point to a first axis perpendicular to said first plane;

c) second handle movement means for moving said handle means between third and fourth defined path of motion in a second defined path of motion, said second path of motion being in a second plane, said handle member being mounted at a second pivot point to a second axis, said second pivot point lying between said handle ends;

d) third handle movement means for moving said handle means in a third defined path of motion, between fifth and sixth defined positions, said elongate handle member having a longitudinal handle axis therethrough, said handle member moving in said third path of motion such that said handle axis moves from a first handle axis position to a second handle axis position, said second handle axis position being generally parallel to and spaced from said first handle axis position, and in which said second handle axis position is spaced from said first handle axis position in a direction generally parallel to said handle axis; and e) fourth handle movement means for moving said handle means in a fourth path of motion between seventh and eighth predetermined positions, said handle member being mounted for twisting rotation about its longitudinal axis.

2. A control system comprising:

(a) handle means including an elongate handle member having first and second opposite ends;

(b) first handle movement means for moving said handle member along a first defined path of motion between first and second defined positions;

(i) said first defined path of motion lying in a first plane;

(ii) said handle member being mounted at a first pivot point on a first axis generally perpendicular to said first plane;

(iii) said first pivot point being positioned between said handle member first and second ends; and, (iv) said handle member being mounted on said first axis for rotation thereabout;

(c) second handle movement means for moving said handle member along a second defined path of motion between third and fourth defined positions;

(i) said second defined path of motion lying in a second plane generally perpendicular to said first plane;
(ii) said handle member being mounted at a second pivot point on a second axis;
(iii) said second pivot point being located between said handle member first and second ends; and
(iv) said handle member being mounted on said second axis for rotation thereabout;

(d) third handle movement means for moving said handle member along a third defined path of motion between fifth and sixth defined positions;
(i) said elongate handle member having a longitudinal handle axis extending therethrough;
(ii) said handle member being movable in said third path of motion such that said longitudinal handle axis moves from a first longitudinal axis position to a second longitudinal axis position, said second longitudinal handle axis position being generally parallel to and spaced from, said first longitudinal handle axis position; and being spaced from said first longitudinal handle axis position, with said second longitudinal handle axis position extending in a direction generally parallel to said longitudinal handle axis; and, (e) fourth handle movement means for moving said handle member along a fourth defined path of motion between seventh and eighth defined positions;
(i) said elongate handle member including an internal handle portion and an external handle portion;
(ii) said internal and external handle portions being coaxial; and,
(iii) said external handle portion being mounted in said handle member such that said external handle portion is rotatable, relative to said internal handle portion, about said longitudinal handle axis.

3. A control system according to claim 2 further comprising safety actuation means including a squeeze trigger located on said handle member.

4. A control system according to claim 2 wherein: each handle movement means includes means for cooperation with each of the other handle movement means, so that each handle movement means is selectively operable to move said handle member as defined, without activation of any of the other handle movement means.

5. A control system comprising:

(a) an elongate handle member having a longitudinal handle axis; said handle member including an internal handle portion and an external handle portion;
(i) said external handle portion being rotatable, relative to said internal handle portion, about said longitudinal handle axis;
(ii) said handle member being pivotally mounted, at a first pivot point, in said control system, to a first axis generally perpendicular to said longitudinal handle axis;
(iii) said handle member being pivotally mounted, at a second pivot point, in said control system, to a second axis generally perpendicular to both of said first axis and said longitudinal handle axis;
(iv) said handle member being mounted in said control system, for selected movement in a path of motion such that said longitudinal handle axis is selectively movable from a first longitudinal axis position to a second longitudinal axis position; said first and second longitudinal axis positions being generally coplanar with, space from and parallel to, one another;

(b) safety actuation means including a squeeze trigger located on said handle member; and, (c) means for selected manipulation of the handle member through any one of the following four movements, is desired, without causing any of the remaining 3 movements:
(i) rotational motion of said external handle portion relative to said coaxial internal handle portion, and about said longitudinal handle axis;
(ii) pivotal motion of said handle member about said first axis;
(iii() pivotal motion of said handle member about said second axis; and
(iv) movement of said handle member to move said longitudinal handle axis between said first longitudinal axis position and said second longitudinal axis position.

6. A control system according to claim 5 including:

(a) first, second, third and fourth control valves;
(b) means for operating said fourth control valve upon rotational motion of said external handle portion relative to said internal handle motion and about said longitudinal handle axis;
(c) means for operating said first control valve upon pivotal motion of said handle member about said first axis;
(d) means for operating said second control valve upon pivotal motion of said handle member about said second axis; and,
(e) means for operating said third control valve upon movement of said handle member to move said longitudinal handle axis between said first longitudinal axis position and said second longitudinal axis position.

7. A control system according to claim 6 wherein said safety actuation means includes switch means preventing each of said first, second, third, and fourth control valves from moving, when said squeeze trigger is not squeezed.

8. Maneuverable equipment comprising:

(a) a derrick;
(b) a telescoping boom system including first and second boom portions; said telescoping boom being mounted on said derrick and constructed and arranged to selectively perform four movement functions including:
(i) rotation about an axis generally perpendicular to a surface on which the derrick sits;
(ii) rotation about an axis generally parallel to the surface on which the derrick sits;
(iii) extension of said first boom portion; and
(iv) extension of said second boom portion; and (c) a control system for controlling said four movement functions; said control system comprising a handle member having a first longitudinal axis; said handle member including an internal handle portion and an external handle portion; and,
(i) said external handle portion being rotatable, relative to said internal handle portion, about said longitudinal handle axis;
(ii) said handle member being pivotally mounted, at a first pivot point, in said control system, to a first axis generally perpendicular to said longitudinal handle axis;
(iii) said handle member being pivotally mounted, at a second pivot point, in said control system, to a second axis generally perpendicular to both of said first axis and said longitudinal handle axis;

(iv) said handle member being mounted in said control system, for selected movement in a path of motion such that said longitudinal handle axis is selectively movable from a first longitudinal axis position to a second longitudinal axis position; said first and second longitudinal axis positions being generally coplanar with, spaced from and parallel to, one another;

(d) means directing a different one of the four movement functions of said telescoping boom upon each of the following four movements of said handle member;

(i) rotational motion of said external handle portion relative to said coaxial internal handle portion, and about said longitudinal handle axis;

(ii) pivotal motion of said handle member about said first axis;

(iii) pivotal motion of said handle member about said second axis; and (iv) movement of said handle member to move said longitudinal handle axis between said first longitudinal axis position and said second longitudinal axis position.

9. A maneuverable equipment system according to claim 8 further including:

(a) means for selected manipulation of the handle member through any one of the following four movements, is desired, without causing any of the remaining 3 movements:

(i) rotational motion of said external handle portion relative to said coaxial internal handle portion, and about said longitudinal handle axis;

(ii) pivotal motion of said handle member about said first axis;

(iii) pivotal motion of said handle member about said second axis; and (iv) movement of said handle member to move said longitudinal handle axis between said first longitudinal axis position and said second longitudinal axis position.

10. A maneuverable equipment system according to claim 8 further comprising safety actuation means including a squeeze trigger located on said handle member.

* * * * *

UNITED STATES PATENT AND TRADEMARK OFFICE

CERTIFICATE OF CORRECTION

PATENT NO. : 5,112,184

DATED : May 12, 1992

INVENTOR(S) : G.D. Tapper et al.

It is certified that error appears in the above-identified patent and that said Letters Patent is hereby corrected as shown below:

Column 2, lines 51 and 52, "operator' " should read --operator's--.

Column 4, line 31, insert --be-- after the word "will".

Column 5, line 47, "7bis" should read --7b is--.

Column 7, line 34, delete "the" after the word "in".

Column 8, line 6, insert --to-- after the word "attached".

Column 8, line 18, delete "a" after the word "with".

Column 14, line 8, delete "from" after the word "toward".

Column 15, line 41, "end" should read --ends--.

Column 17, line 64, "manners" should read --matters--.

Column 17, lines 65 and 66, "principals" should read --principles--.

Column 19, line 21 (claim 2), insert --, said second longitudinal handle axis position-- after the word "and".

UNITED STATES PATENT AND TRADEMARK OFFICE

CERTIFICATE OF CORRECTION

PATENT NO. : 5,112,184

DATED : May 12, 1992

INVENTOR(S) : G.D. Tapper et al.

It is certified that error appears in the above-identified patent and that said Letters Patent is hereby corrected as shown below:

Column 20, line 14 (claim 5), "(iii()" should read --(iii)--.

Signed and Sealed this

Seventh Day of December, 1993

Bruce Lehman

*Attest:*

BRUCE LEHMAN

*Attesting Officer*

*Commissioner of Patents and Trademarks*